United States Patent [19]

Reed

[11] 4,390,160

[45] Jun. 28, 1983

[54] VALVES FOR PRESSURIZED DISPENSING CONTAINERS

[76] Inventor: Norman L. Reed, The Wickets, Walnut Ave., West Winch, King's Lynn, Norfolk, England

[21] Appl. No.: 165,475

[22] Filed: Jul. 2, 1980

[51] Int. Cl.[3] ..... B65D 83/00

[52] U.S. Cl. ..... 251/149.6; 137/322; 251/353; 251/354; 222/402.24

[58] Field of Search ..... 251/149.6, 149.7, 339, 251/223, 353; 137/322; 222/402.24

[56] References Cited

U.S. PATENT DOCUMENTS

| | | | |
|---|---|---|---|
| 2,478,052 | 8/1949 | Palm | 251/149.6 X |
| 2,727,759 | 12/1955 | Elliott | 251/149.6 X |
| 3,283,785 | 11/1966 | Beres et al. | 251/339 X |
| 3,583,608 | 6/1971 | Green | 222/402.24 |
| 3,627,263 | 12/1971 | Warren et al. | 251/353 |

*Primary Examiner*—A. Michael Chambers

[57] ABSTRACT

A valve for a pressurized dispensing container comprises a valve housing (11) defining a valve chamber (15) and having at its lower end an inlet for pressurized material. An annular flexible seal (12) closes the upper end of the chamber, there is a cup-shaped valve member (13) within the chamber, and a hollow actuator stem (16) extends in sliding, sealed relation through the seal (12) and engages the valve member (13) at its lower end. A spring (14) urges the valve member (13) upwardly into sealing engagement with the seal (12), the actuator stem (16) being manually moveable downwardly against the action of the spring (14) to unseal the valve member (13) and open the valve. The wall of the actuator stem (16) includes at least one radial, aperture (24) adjacent to but spaced from the lower end of the actuator stem and defining a lip portion (25) adjacent the lower end of the actuator. The aperture or apertures (24) place the interior of the actuator stem (16) in communication with the interior of the valve member (13) and the lip portion (25) serves to restrain the lower end of actuator stem (16) from passing through the seal (12) if the actuator stem is moved upwardly of the seal.

6 Claims, 2 Drawing Figures

VALVES FOR PRESSURIZED DISPENSING CONTAINERS

BACKGROUND OF THE INVENTION

The invention relates to valves for pressurized dispensing containers and is particularly, but not exclusively, concerned with such valves in which a high discharge rate is required.

Known valves for this purpose may be of the type comprising a valve housing defining a valve chamber and having at its lower end an inlet for pressurized material, an annular flexible seal closing the upper end of the chamber, a hollow actuator member extending in sliding, sealed rotation through the seal and having secured to it, within the valve chamber, a valve member in the form of a cup, the interior of which is in permanent communication with the interior of the actuator member through radial apertures in the wall of the actuator member, and a spring urging the valve member upwardly into sealing engagement with the said seal, the actuator member being manually moveable downwardly against the action of the spring to unseat the valve member to open the valve.

Such a valve is described in our earlier British Pat. No. 1293136 and, in that case, the radial apertures in the actuator member are formed by slots which define between them legs, the legs being frictionally retained in the valve member. While providing good flow characteristics, a potential disadvantage of that arrangement is that, if the legs become disengaged from the valve member, the actuator member may slide outwardly through the seal with relatively little difficulty and thus the actuator member may be accidentally knocked off the valve. This is undesirable particularly where the valve is used in applications such as fire extinguishers.

SUMMARY OF THE INVENTION

The present invention provides a valve for a pressurized dispensing container and comprising a valve housing defining a valve chamber and having at its lower end an inlet for pressurized material, an annular flexible seal closing the upper end of the chamber, a cup-shaped valve member within the chamber, a hollow actuator stem extending in sliding, sealed relation through the seal and engaging the valve member at its lower end, and a spring urging the valve member upwardly into sealing engagement with the seal, the actuator stem being manually moveable downwardly against the action of the spring to unseat the valve member and open the valve, in which the wall of the actuator stem includes at least one radial, aperture adjacent to but spaced from the lower end of the actuator stem and defining a lip portion adjacent the lower end of the actuator, the aperture or apertures placing the interior of the actuator stem in communication with the interior of the valve member and the lip portion serving to restrain the lower end of actuator stem from passing through the seal if the actuator stem is moved upwardly of the seal.

In this valve, the lip portion formed by the aperture or apertures in the actuator stem engages the annular seal if the actuator stem moves outwardly of the seal and this restrains the stem from falling out of the valve.

Preferably there are two apertures, each being formed by a circular hole in the wall of the actuator stem, the lip portion being formed by the lower arcuate edges of the holes.

Preferably the diameter of the holes is such that the circumferential width of the holes at their centres is at least 50% of the circumference of the actuator stem.

The actuator stem may be retained in assembled relation with the valve member by frictional engagement of the lower end of the actuator stem with the interior of the valve member.

BRIEF DESCRIPTION OF THE DRAWINGS

A preferred embodiment of a valve for a pressurized dispensing container according to the invention will now be described, by way of example, with reference to the accompanying drawings, in which.

DESCRIPTION OF A PREFERRED EMBODIMENT

Figure 1:
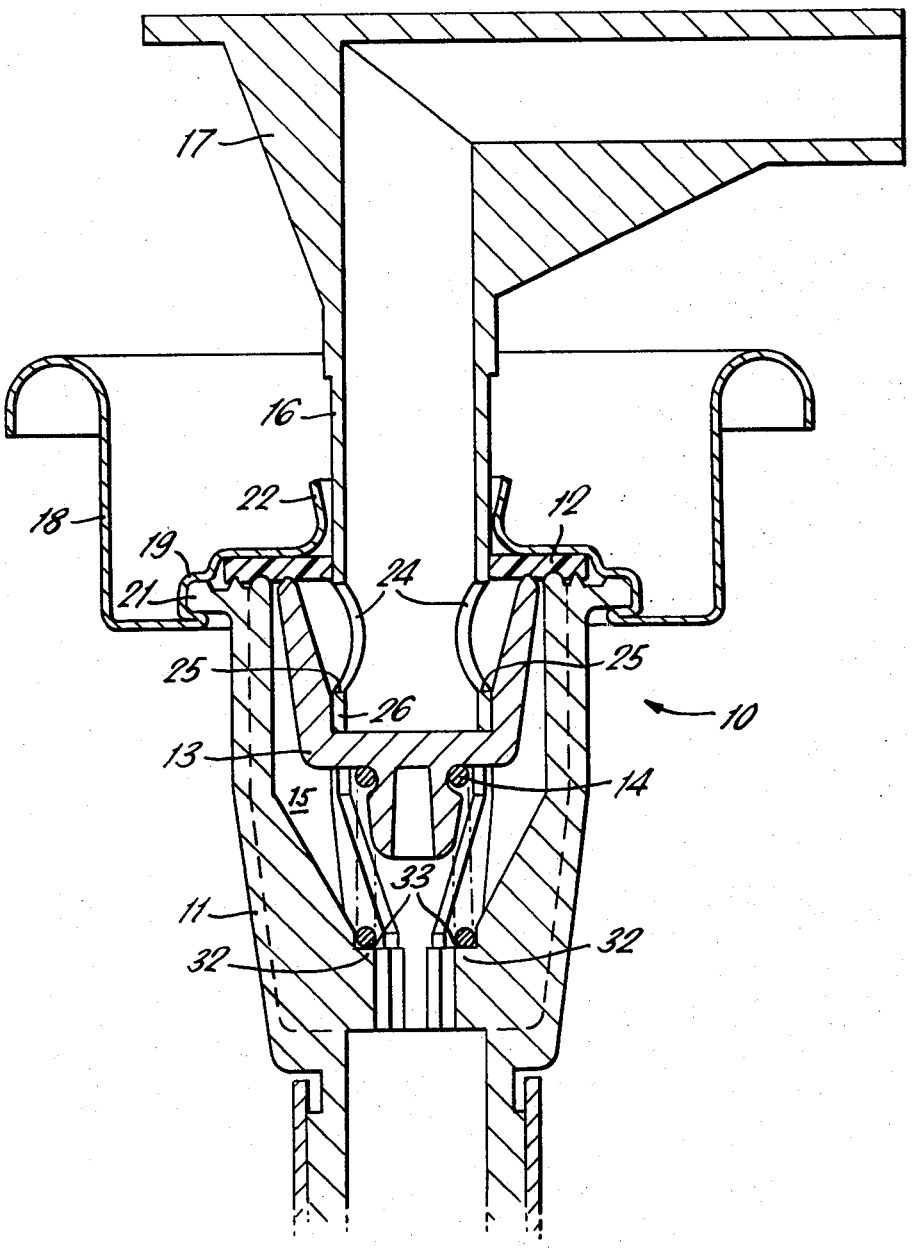
FIG. 1 is a section through a valve according to the invention.

Referring first to FIG. 1, the valve 10 comprises a valve housing 11 defining a valve chamber 15, a seal 12, a cup-shaped valve member 13 spring loaded towards the seal by a coil compression spring 14, a hollow acutator stem 16 extending in sliding sealed engagement through the seal 12, a discharge nozzle 17 at the upper end of the stem and a sheet metal mounting cup 18, the outer periphery of which is shaped for connecting, and subsequent attachment by crimping, to a container. The mounting cap 18 has a central boss 19 in which is received a flange 21 of the housing 11 and the side wall of the boss is deformable by pressing to clamp it about the flange to secure the flange and housing together and to clamp the annular flexible seal 12, which is of resilient material, therebetween. The mounting cap 18 also has an upstanding flange 22 around its central hole to guide the stem 16.

The lower part of the hollow actuator stem 16 includes two diametrically opposed circular holes 24 which place the interior of the hollow actuator stem in communication with the interior of the valve cup 13. The diameter of the holes 24 is such that, at the level of their centres, the circumferential width of the two holes is at least 50% and in one embodiment approximately 60% of the circumference of the actuator stem. The lower arcuate edges 25 of the holes 24 define a lip portion of the actuator stem and the actuator stem is maintained in assembled relation with the valve member 13 by frictional engagement of the lower end portion 26 of the actuator stem with the interior surface of the wall of the valve member 13. Both parts (13 and 16) are preferably made of plastics material, the resilient nature of which enables the parts to be securely attached to each other merely by pushing the lower end of the stem into the valve cup.

The lower end of the spring 14 is located by radial generally rectangular vanes 32 having shoulders 33 formed in the lower portion of the housing. These vanes are designed to secure minimum restriction of flow of material in this region of the housing.

In use, when the valve 10 is assembled with the container for a pressurized material, the container is normally closed by virtue of the seal made between the seal 12 and the upper edge of the valve member 13. To discharge a quantity of material, the stem 16 is pressed downwardly to unseat the valve member, whereupon material flows over the upper edge of the valve member to the interior thereof, and then through the holes 24 in the stem 16 to the interior of the stem and so to the discharge nozzle. The valve 10 is particularly intended for use with fire extinguishers and the like and is designed for a high flow rate through the valve. For this purpose, the valve member 13 has a frustoconical upper portion, the internal wall of which is adapted to give the material flowing into the valve member an inwardly radial component of flow. Furthermore, the upper edges of the holes 24 in the stem 16 are positioned very close to the plane of the upper edge of the valve member 13, thus facilitating the flow of material from the interior of the cup shaped valve member to the interior of the actuator stem.

Figure 2:
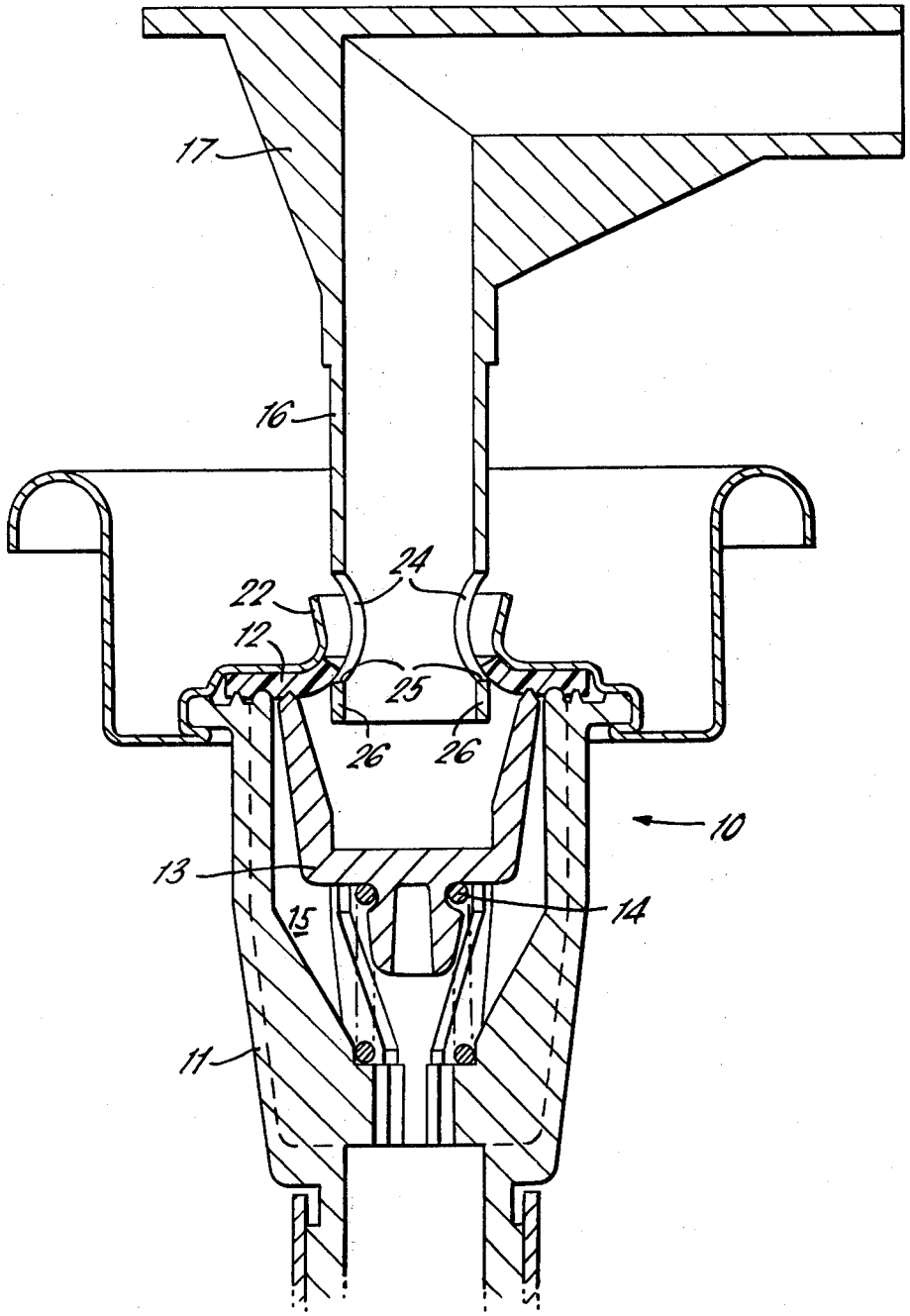
FIG. 2 is a view similar to FIG. 1 but showing the valve with the actuator stem partly removed from the valve.

Apart from providing a sufficiently high flow rate through the valve, the holes 24, and in particular the lip portions 25 defined by their lower edges, help to prevent the actuator stem being accidently knocked from the valve. If the actuator stem is knocked sufficiently hard to disengage its lower end portion 26 from the valve member 13, the actuator stem will readily slip to the position shown in FIG. 2. However, the lip portion 25 will then engage the inner annular edge of the seal 12 and further movement of the actuator stem upwardly (as viewed in FIG. 2) will tend to press the seal 12 against the valve cup 18 thus requiring a considerable force to pull the lower end portion of the actuator stem out of the valve. It is found in practice that this arrangement renders it extremely unlikely that the actuator stem will be accidently knocked from the valve since the force required to pull the lower end of the actuator stem out of the valve from the position shown in FIG. 2 is relatively large.

Although the valve is referred to in the foregoing description as being vertical in use, with the discharge nozzle and actuator stem uppermost, it will be understood that this is simply for ease and convenience of description and that valves in accordance with the invention may be used in an inverted or other position if desired.

I claim:

1. A valve for a pressurized dispensing container and comprising a valve housing defining a valve chamber and having at its lower end an inlet for pressurized material, an annular flexible seal clamped into position closing the upper end of the chamber, a cup-shaped valve member within the chamber, a hollow actuator stem extending in sliding, sealed relation through the seal and engaging the valve member at its lower end, and a spring urging the valve member upwardly into sealing engagement with the seal, the actuator stem being manually moveable downwardly against the action of the spring to unseat the valve member and open the valve, in which the wall of the actuator stem includes at least one radial aperture adjacent to but spaced from the lower end of the actuator stem and of a height dimension sufficiently greater than the thickness of said flexible seal that a substantial portion of a entire peripheral segment of the inner annulus of said flexible seal is not in contact with an outer surface of said stem and can expand to protrude inwardly of said aperture when said aperture and seal are in the same plane, thereby defining a lip extending along the lower portion of said aperture against which said flexible seal non-stem contacting segment is engageable upon withdrawal of said actuator stem from engagement with said valve member, the aperture placing the interior of the actuator stem in communication with the interior of the valve member and the lip portion serving to restrain the lower end of actuator stem from passing through the seal if the actuator stem is moved upwardly of the seal.

2. A valve as claimed in claim 1 in which the annular flexible seal is of resilient material and is clamped between the valve housing and a mounting cup clampingly affixable to the valve housing.

3. A valve as claimed in claim 1 in which the actuator stem is retained in assembled relation with the valve member by frictional engagement of the lower end of the actuator stem with the interior of the valve member.

4. A valve as claimed in claim 1 in which said aperture height dimension is at least twice the thickness of said flexible seal.

5. A valve as claimed in claim 4 in which there are two apertures, each aperture being formed by a circular hole in the wall of the actuator stem, the lip portion being formed by the lower arcuate edges of the holes.

6. A valve as claimed in claim 5 in which the diameter of the holes is such that the circumferential width of the holes at their centres is at least 50% of the circumference of the actuator stem.

* * * * *